US007180466B2

(12) United States Patent
Kuroda

(10) Patent No.: US 7,180,466 B2
(45) Date of Patent: Feb. 20, 2007

(54) UNBALANCED ANTENNA

(75) Inventor: Shinichi Kuroda, Tokyo (JP)

(73) Assignee: Sony Corporation, Tokyo (JP)

( * ) Notice: Subject to any disclaimer, the term of this patent is extended or adjusted under 35 U.S.C. 154(b) by 98 days.

(21) Appl. No.: 10/498,518

(22) PCT Filed: Oct. 15, 2003

(86) PCT No.: PCT/JP03/13185

§ 371 (c)(1),
(2), (4) Date: Jan. 24, 2005

(87) PCT Pub. No.: WO2004/038860

PCT Pub. Date: May 6, 2004

(65) Prior Publication Data

US 2006/0214869 A1 Sep. 28, 2006

(30) Foreign Application Priority Data

Oct. 23, 2002 (JP) ..... 2002-307910

(51) Int. Cl.
*H01Q 1/38* (2006.01)
*H01Q 21/00* (2006.01)

(52) U.S. Cl. ..... 343/846; 343/700 MS; 343/773

(58) Field of Classification Search ..... 343/700 MS, 343/702, 846, 848, 773
See application file for complete search history.

(56) References Cited

U.S. PATENT DOCUMENTS 5,406,295 A * 4/1995 Baranski et al. ..... 343/713

(Continued)

FOREIGN PATENT DOCUMENTS

DE C-718695 3/1942

(Continued)

OTHER PUBLICATIONS

Kin-Lu Wong, et al., "Stripline-fed printed triangular monopole", Electronics Letters, vol. 33, No. 17, XP-006007818, Aug. 14, 1997, pp. 1428-1429.

*Primary Examiner*—Tan Ho
(74) *Attorney, Agent, or Firm*—Oblon, Spivak, McClelland, Maier & Neustadt, P.C.

(57) ABSTRACT

An unbalanced antenna having a radiation conductor and a ground conductor provided with a predetermined gap therebetween is provided. At least a predetermined part of the ground conductor, the predetermined part being opposed to the radiation conductor, is left so that it keeps functioning as a pole for forming a near electromagnetic-field distribution together with the radiation conductor opposed to the ground conductor. Further, a part of the reduced ground conductor, the part being near an end at a predetermined distance from the feed section, includes a conductor having low conductivity for obtaining impedance matching. Where the ground conductor is significantly reduced, mode mismatch inevitably occurs. Therefore, at least one part of an external conductor of a coaxial feed line connected to the feed section is covered by a current absorber, so as to forcefully reduce a leakage current. Subsequently, the ground conductor can be reduced and the antenna characteristic can be maintained.

27 Claims, 16 Drawing Sheets

U.S. PATENT DOCUMENTS

| | | | | |
|---|---|---|---|---|
| 5,828,340 | A | 10/1998 | Johnson | |
| 5,847,682 | A * | 12/1998 | Ke | 343/752 |
| 5,986,615 | A | 11/1999 | Westfall et al. | |
| 5,990,845 | A * | 11/1999 | Sharp et al. | 343/846 |
| 6,014,114 | A | 1/2000 | Westfall et al. | |
| 6,307,525 | B1 | 10/2001 | Bateman et al. | |
| 6,809,687 | B2 * | 10/2004 | Yuanzhu | 343/700 MS |
| 7,019,698 | B2 * | 3/2006 | Miyoshi et al. | 343/700 MS |
| 2005/0264462 | A1 * | 12/2005 | Yanagi et al. | 343/773 |

FOREIGN PATENT DOCUMENTS

| | | |
|---|---|---|
| DE | 196 47 678 A1 | 5/1998 |
| EP | 1 189 305 A2 | 3/2002 |
| JP | 41-8371 | 4/1966 |
| JP | 8-139515 | 5/1996 |
| JP | 9-223921 | 8/1997 |
| WO | 96/24964 | 8/1996 |

* cited by examiner

[ELEVATION]

UNBALANCED ANTENNA

This application is a 371 of PCT/JP 03/13185 filed on Oct. 15, 2003.

TECHNICAL FIELD

The present invention relates to an antenna used for wireless communications including a wireless LAN or the like, and particularly relates to an unbalanced antenna having a radiation electrode and a ground electrode that are provided with a predetermined gap therebetween.

More specifically, the present invention relates to an unbalanced antenna that can be mounted on a small wireless communications device, and particularly relates to an unbalanced antenna that has a ground electrode reduced in size and that maintains a predetermined antenna characteristic.

BACKGROUND ART

Recently, as wireless LAN systems become faster and less expensive, they are now in significantly increasing demand. Particularly, in these days, the introduction of personal area networks (PAN) has been examined for performing information communications by constructing a small-scale wireless network between a plurality of electronic apparatuses around a person. For example, various wireless communications systems using frequency bands including 2.4 GHz band, 5 GHz band, and so forth, and requiring no licenses issued by oversight authorities have been established.

In the case of the wireless communications using the wireless LAN or the like, information is transmitted via an antenna. For example, various kinds of unbalanced antennas are in practical use. As a rule, the unbalanced antennas have a radiation conductor and a ground conductor that are provided with a predetermined gap therebetween. An electric signal is fed to the gap. In general, the electric signal is fed from the rear side of the ground conductor. In this case, a hole is bored in the ground conductor and the radiation conductor is extended toward the rear side.

Example shapes of the radiation conductor are shown in FIG. 1 illustrating a monopole antenna, FIG. 2 illustrating a helical antenna, FIG. 3 illustrating a plate-like monopole antenna, and FIG. 4 illustrating a monoconical antenna.

As a relative merit of the unbalanced antenna versus a balance antenna, the unbalanced antenna can be directly connected to a coaxial transmission line used as a line for feeding an electric signal. In general, the coaxial transmission line is highly resistant to an external noise. That is to say, a coaxial cable basically functions as an unbalance cable that can function in keeping with the unbalanced antenna. On the other hand, where the balance antenna is used, a balance-to-unbalance converter is needed between the balance antenna and the coaxial cable. Further, since the ground conductor can be used with a case ground conductor of the device or provided so as to be in intimate contact therewith, the device can be downsized, which is advantageous for mounting.

In general, the ground conductor has a disk shape measuring at least a half wave or so in diameter. However, it is often difficult to achieve the size for mounting the ground conductor on a small wireless apparatus. A significantly small ground conductor deteriorates its reception characteristic or the like, thereby affecting the operation of the antenna.

The deterioration of the unbalanced antenna's characteristic due to the downsized ground electrode will now be described below. Here, calculations are performed for studying the characteristic change caused by significantly reducing the size of a disk-shaped ground conductor measuring a half wave in diameter by referring to a disk monopole antenna shown in FIG. 5, as an example. An electric signal is fed via the coaxial transmission line from the rear side of the ground electrode. The conditions for calculating the antenna characteristic are shown below.

1. Radiation Conductor a metal having a conductivity of $1\times10^7$ S/m 24.8 mm in diameter, 0.8 mm in thickness 2. Ground Conductor a metal having a conductivity of $1\times10^7$ S/m reduced from a disk being 50 mm in diameter and 0.8 mm in thickness to a rectangular plate being 24.8×4×0.8 mm (reduced by 5 percent in area ratio)

3. Feed Section a gap of 0.8 mm a coaxial transmission line having a characteristic impedance of 50 Ω

FIG. 6 illustrates the calculation result of a characteristic of the disk monopole antenna having the disk-like ground conductor measuring a half wave in diameter. In this drawing, the VSWR (Voltage Standing Wave Ratio) characteristic is shown on the left side, the radiation directivity in a vertical surface at 3 GHz is shown in the middle, and the surface-current density distribution also at 3 GHz (the density is shown by concentration) is shown on the right side.

As shown in this drawing, the VSWR value of about 2 or less is achieved over the range from 3.5 to 9 GHz. That is to say, a suitable impedance matching characteristic can be obtained over an ultra-wide band. Further, since the radiation directivity in the vertical surface at 3 GHz forms an 8-shape having peaks substantially along a horizontal direction, this disk monopole antenna has a characteristic similar to the inherent characteristic thereof (In a floor-limit frequency band, this antenna has a characteristic same as that of a dipole antenna.). According to the surface-current density distribution at this time, the level of an unnecessary leakage current flowing on an external conductor of the coaxial transmission line is low (Where the ground conductor has an infinite width, no leakage currents flow on the external conductor of the feed transmission line on the rear side.). Therefore, this calculation result of the radiation directivity is acceptable.

FIG. 7 illustrates the calculation result of a characteristic of the disk monopole antenna, where the ground conductor is reduced in size. As is the case with FIG. 6, the VSWR characteristic is shown on the left side, the radiation directivity in a vertical surface is shown in the middle, and the surface-current density distribution is shown on the right side.

A comparison between the characteristic shown in FIG. 7 and that shown in FIG. 6 shows a deterioration of the impedance-matching characteristic. The VSWR at from 3.5 to 9 GHz increases up to 3. The radiation directivity in the vertical surface at 3 GHz points downward in the extreme and drops to around −10 dBi in a horizontal direction. According to the surface-current density distribution at this time, a large leakage current flows on the external conductor of the coaxial transmission line and a radiation element from this leakage current affects the inherent radiation directivity. That is to say, the radiation directivity changes according to how the feed line is wired. In some cases, the above-described disturbances in the radiation directivity can cause a significant problem.

In summary, where the unbalanced antenna is mounted on the small wireless communications device and the ground conductor is reduced in size, it becomes impossible to make the most of the inherent characteristic of the antenna.

DISCLOSURE OF INVENTION

An object of the present invention is to provide an excellent unbalanced antenna having a radiation electrode and a ground electrode that are provided at a predetermined gap.

Another object of the present invention is to provide an excellent unbalanced antenna having a reduced ground electrode and maintaining its antenna characteristic.

For solving the above-described problems, according to a first aspect of the present invention, there is provided an unbalanced antenna comprising a radiation conductor and a ground conductor that are provided with a predetermined gap therebetween. The ground conductor comprises:

a predetermined part functioning as a pole for forming a near electromagnetic-field distribution together with the radiation conductor opposed to the ground conductor and a predetermined part for contributing to impedance matching.

The unbalanced antenna according to the first aspect of the present invention may further comprise a predetermined part for contributing to mode matching.

Inventors of the present invention divided the operation of the ground conductor of the unbalanced antenna into the following three points, including:

(a) a function of serving as an end for forming a near electromagnetic field distribution between itself and the radiation conductor opposite thereto, (b) contribution to the impedance matching, and (c) contribution to the mode (transmission mode or excitation mode) matching.

For maintaining the operation (a), at least the part being opposed the radiation conductor should be left, as a minimum requirement.

Further, the impedance variation due to the size reduction of the ground conductor, that is, a change in the voltage-and-current ratio in a feed section may be compensated by mounting a suitable resistance component on the ground conductor. That is to say, for securing the operation (b), a part of the reduced ground conductor, the part being near an end at a predetermined distance from the feed section, includes a conductor having low conductivity.

In addition to that, the mode matching described in (c) is achieved on the precondition that feeding is performed via a coaxial transmission line. Where the ground conductor is significantly reduced, mode mismatch inevitably occurs. However, on the above-described precondition, all unnecessary unbalance components flow on an external conductor of the coaxial transmission line (referred to as a leakage current) without entering the coaxial transmission line. Subsequently, where a system for forcefully blocking the leakage current by covering at least a predetermined part of the external conductor of the coaxial feed line connected to the feed section by using a current absorber, for example, for securing the operation (c), it may be possible to compensate for the mode mismatch.

Here, the conductivity of the ground conductor is reduced continuously or in stages along a direction from a part near the feed section to an end.

According to a second aspect of the present invention, there is provided an unbalanced antenna comprising a radiation conductor and a ground conductor that are provided with a predetermined gap therebetween.

The ground conductor is reduced in size except at least a predetermined part substantially opposed to the radiation conductor and divided into a plurality of parts according to a distance from a feed section, and wherein electric resistors are connected between the divided ground conductors.

Here, a predetermined part of an external conductor of a coaxial transmission line connected to the feed section of the unbalanced antenna may be covered by a current absorber.

Further, at least an electric resistor having a suitable resistivity may be provided between or among the divided ground conductors, respectively. In this case, the impedance matching can be achieved by setting the conductivity of the part near the feed section to a high level and setting the conductivity of parts near the ends to a low level.

Where the present invention is used for an unbalanced antenna for a relatively narrow band, such as a monopole antenna, a current blocking system such as a blocking ceramic tube (Sperrtopf tube) having a limited frequency characteristic may be provided in place of the current absorber on the external conductor of the coaxial transmission line connected to the feed section.

According to a third embodiment of the present invention, there is provided an unbalanced antenna comprising a single-layered dielectric substrate having two electrode surfaces, that is, upper-layer and lower-layer electrode surfaces, a plate-like radiation electrode and a transmission-line electrode connected to the radiation electrode that are formed on one of the surfaces of the single-layered dielectric substrate, a ground electrode formed near a predetermined part of the other surface of the single-layered dielectric substrate, the predetermined part being opposed to the transmission-line electrode, at least one sub-ground electrode provided, so as to be adjacent to the ground electrode, an electric resistor connected between the ground electrode and the sub-ground electrode, and an electric-signal feed path provided between the transmission-line electrode and the ground electrode.

According to a fourth embodiment of the present invention, there is provided an unbalanced antenna comprising a single-layered dielectric substrate having two electrode surfaces, that is, upper-layer and lower-layer electrode surfaces, a plate-like radiation electrode and a transmission-line electrode connected to the radiation electrode that are formed on one of the surfaces of the single-layered dielectric substrate, a ground electrode that is flush with the radiation electrode and the transmission-line electrode and divided, so as to sandwich the transmission-line electrode, at least one sub-ground electrode provided, so as to be adjacent to the ground electrode, an electric resistor connected between the ground electrode and the sub-ground electrode, and an electric-signal feed path provided between the transmission-line electrode and the ground electrode.

According to a fifth embodiment of the present invention, there is provided an unbalanced antenna comprising a multi-layered dielectric substrate having three electrode surfaces, that is, upper-layer, intermediate-layer, and lower-layer electrode surfaces, a plate-like radiation electrode and a transmission-line electrode connected to the radiation electrode that are formed on the intermediate-layer surface of the multi-layered dielectric substrate, a ground electrode formed near a predetermined part of the lower-layer surface of the multi-layered dielectric substrate, the predetermined part being opposed to the transmission-line electrode, at least one sub-ground electrode provided, so as to be adjacent to the ground electrode, an electric resistor connected between the ground electrode and the sub-ground electrode, an opposed ground electrode formed near a predetermined part of the upper-layer surface of the multi-layered dielectric substrate, the predetermined part being opposed to the transmission-line electrode, two or more inter-ground-electrode connection sections for electrically connecting the ground electrode to the opposed ground electrode, and an electric-signal feed path formed between the transmission-line electrode and the ground electrode, and/or the transmission-line electrode and the opposed ground electrode. Here, the inter-ground-electrode connection sections are provided on both sides of the transmission-line electrode on the intermediate-layer surface of the multi-layered dielectric substrate, so as to sandwich the transmission-line electrode.

In the unbalanced antennas according to the third to fifth aspects, the ground electrode and the transmission-line electrode form a so-called micro-strip line, a coplanar line, or a strip line. Although the unbalanced antennas have the reduced ground electrodes, they can achieve a fine impedance-matching characteristic, which is an advantage of the present invention, as is the case with the unbalanced antenna according to the first aspect of the present invention.

Here, the breadth of the entire ground electrode including the sub-ground electrode may be determined to be substantially the same as that of the radiation electrode, so as to maintain the function of serving as a pole opposite to the radiation electrode.

Further, the electric resistor may be formed by using a chip-type resistor.

Further, a plurality of the sub-ground electrodes may be provided end to end, so as to be adjacent to one another.

Further, the unbalanced antenna according to the fifth aspect of the present invention may further comprise a current absorber covering a predetermined part of a periphery of the ground electrode and the opposed ground electrode. Subsequently, it becomes possible to improve the mode (transmission mode or excitation mode) matching.

According to a sixth embodiment of the present invention, there is provided an unbalanced antenna comprising:

an insulator having opposing end faces, a radiation electrode formed on a surface of a substantially cone-shaped indentation formed on one of end faces of the insulator, or formed in the indentation, so as to fill the entire indentation, a radiation-electrode extension portion formed by extending the radiation electrode from an approximate apex of the indentation so that the radiation-electrode extension portion reaches the other end face opposed to the end face of the insulator, a ground electrode formed on the other end face of the insulator, so as to enclose the radiation-electrode extension portion, at least one circumferential slit portion formed by peeling off a predetermined periphery part of the ground electrode, an electric resistor embedded in the circumferential slit portion, and an electric-signal feed section provided between the radiation-electrode extension portion and the ground electrode.

Here, the size of the ground electrode may preferably be substantially the same as that of the base of the indentation.

Further, the ground electrode may have a step and the circumferential slit portion may constitute an edge of the step, so as to be easily mounted on a substrate.

Further objects, features, and advantages of the present invention will be disclosed in detail with reference to embodiments and attached drawings of the present invention that will be described later.

BEST MODES FOR CARRYING OUT THE INVENTION

Embodiments of the present invention will now be described with reference to the drawings.

The inventors divided the operation of a ground conductor of an unbalanced antenna into the following three points, including:

(a) a function of serving as an end for forming a near electromagnetic field distribution between itself and a radiation conductor opposite thereto, (b) contribution to impedance matching, and (c) contribution to mode (transmission mode or excitation mode) matching.

In an ordinary unbalanced antenna, the operation of the ground conductor is centralized to (a). However, the operation (a) is used only for electromagnetic-field components contributed to radiation directivity and separated from the operations (b) and (c). The operation (a) can be directly referred to as an "operation for forming substantially normal current distribution on the radiation conductor (original distribution obtained where the ground is unlimited)".

For maintaining the operation (a), at least the part opposed to the radiation conductor should be left, as a minimum requirement. Further, the impedance variation due to the size reduction of the ground conductor, that is, a change in the voltage-and-current ratio in a feed section may be compensated by mounting a suitable resistance component on the ground conductor. That is to say, for maintaining the operation (b), a part of the reduced ground conductor, the part being near an end at a predetermined distance from the feed section, includes a conductor having low conductivity.

In addition to that, the mode matching described in (c) is achieved on the precondition that feeding is performed via a coaxial transmission line. Where the ground conductor is significantly reduced, mode mismatch inevitably occurs. However, on the above-described precondition, all unnecessary unbalance components flow on an external conductor of the coaxial transmission line (referred to as a leakage current) without entering the coaxial transmission line. Subsequently, where a system for forcefully blocking the leakage current is provided, for securing the operation (c), by covering at least a single part of the external conductor of the coaxial feed line connected to the feed unit by using a current absorber, for example, it may be possible to compensate for the mode mismatch.

Figure 7:
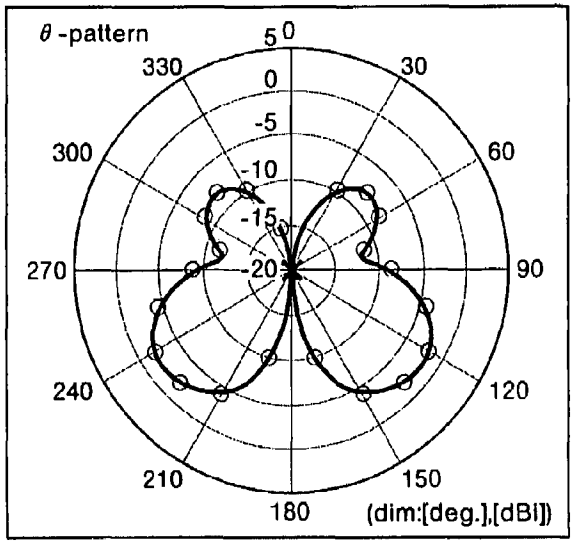
FIG. 7 shows the calculation result of a characteristic of the disk monopole antenna having a ground conductor reduced in size.
Figure 7:
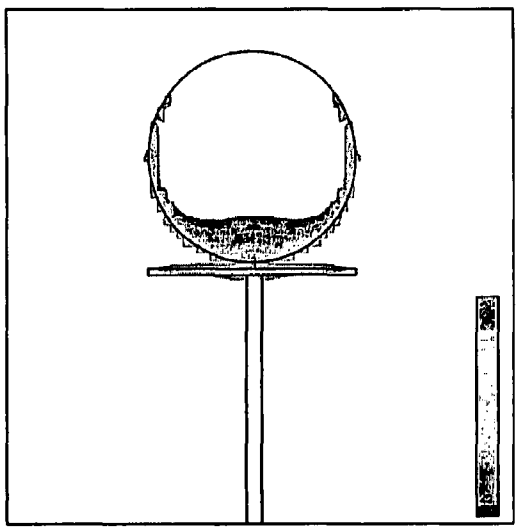
Figure 7:
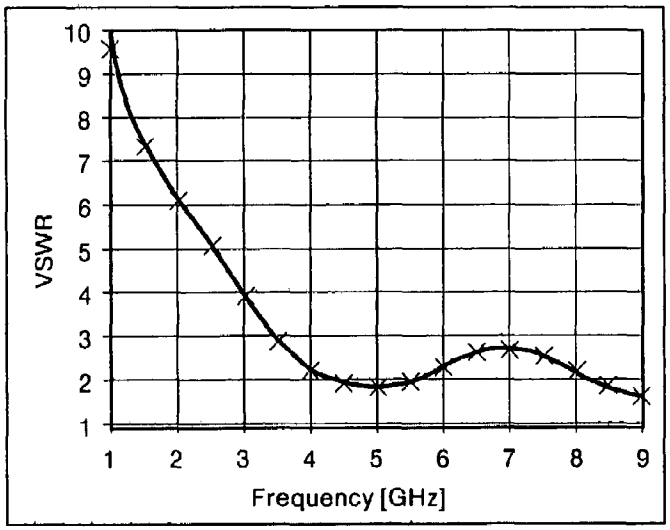

When compared to the characteristic deterioration of the unbalanced antenna due to the reduced ground conductor shown in FIG. 7, the VSWR characteristic shown in the left part of this drawing can be compensated by mounting the resistance component. Further, the leakage-current blocking system reduces the radiation-directivity disturbance shown in the middle of this drawing.

With the above-described logics as a background, embodiments of the present invention will now be described with reference to the drawings.

Figure 8:
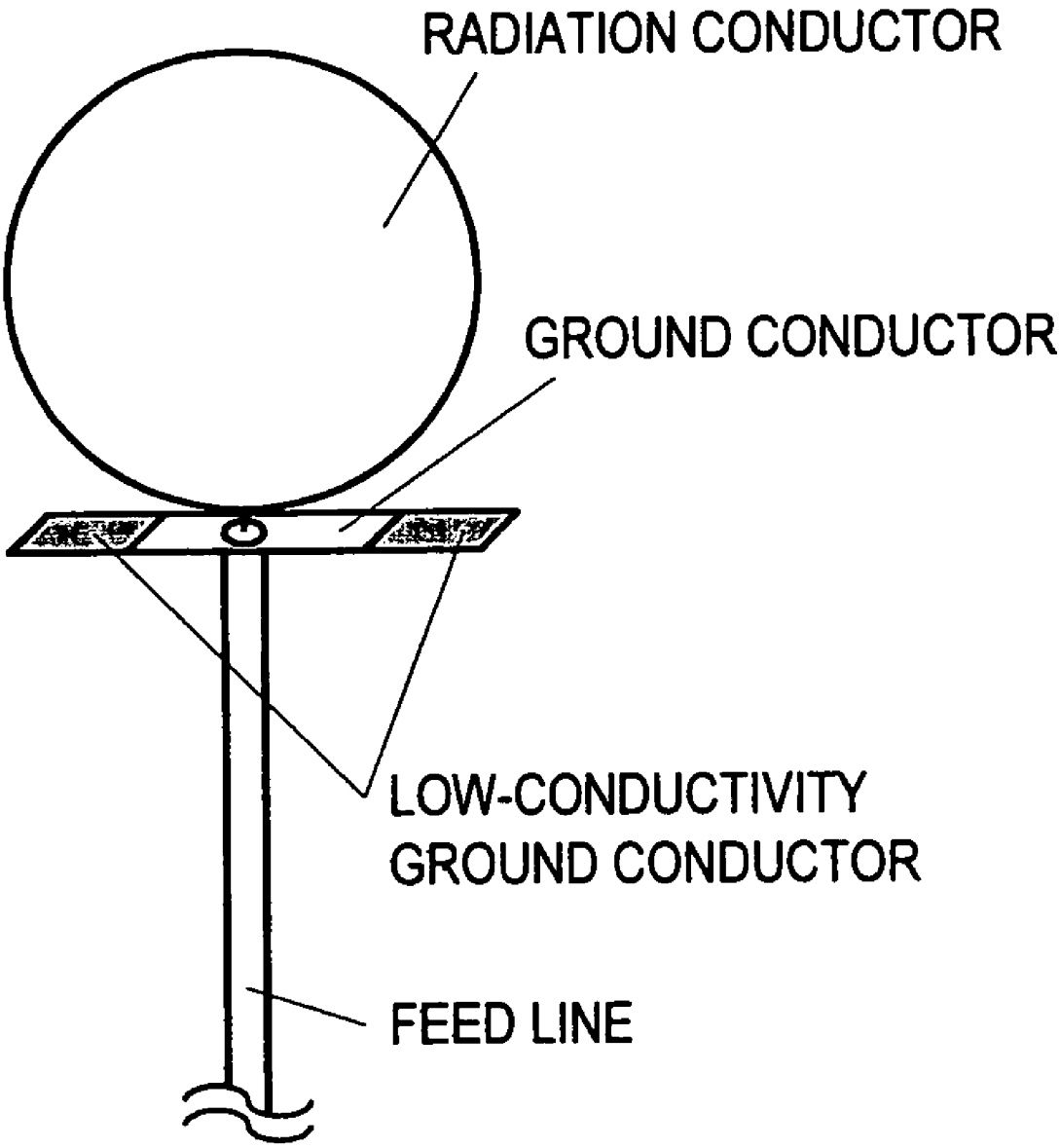
FIG. 8 schematically shows the configuration of an unbalanced antenna according to a first embodiment of the present invention.

FIG. 8 schematically illustrates the configuration of an unbalanced antenna according to an embodiment of the present invention. This drawing shows a disk monopole antenna, as an example unbalanced antenna.

The disk monopole antenna shown in FIG. 8 includes a disk-like radiation conductor and a rectangular-plate-like ground conductor that are formed with a predetermined gap therebetween. In this case, the size of the ground conductor is limited, so as to correspond to a part substantially opposite to the radiation conductor. Further, a part near an end of the ground conductor, the end being provided at a predetermined distance from a feed section, is formed by using a conductor with lower conductivity. An electric signal is fed through the coaxial transmission line from the rear side of the ground conductor. The coaxial transmission line is finally connected to the gap.

Figure 1:
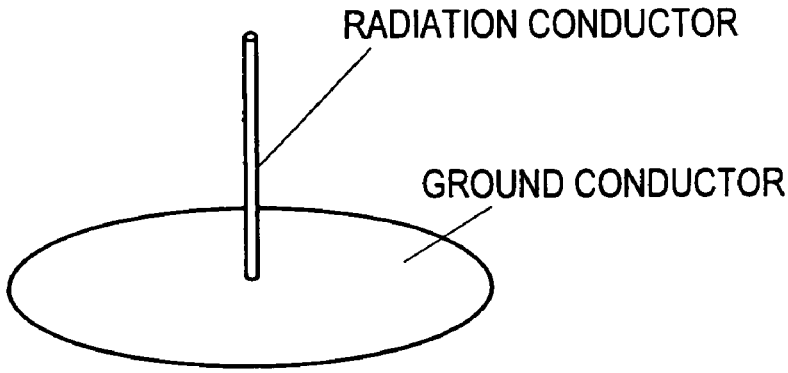
FIG. 1 illustrates an example configuration of a radiation conductor.
Figure 2:
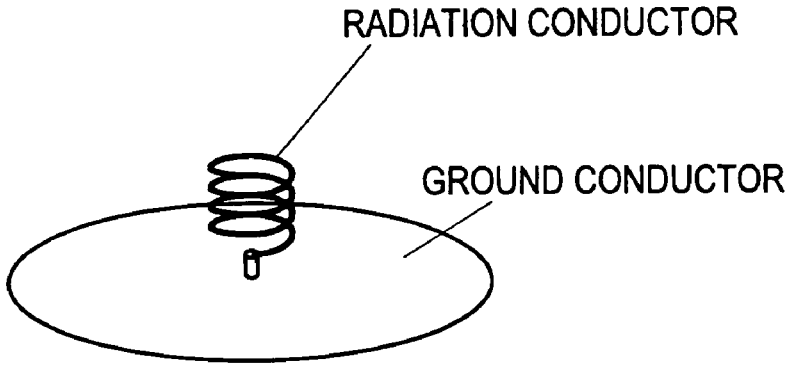
FIG. 2 illustrates another example configuration of the radiation conductor.
Figure 3:
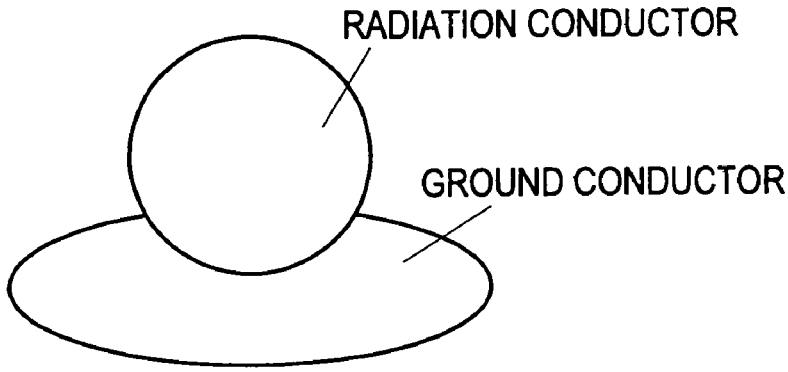
FIG. 3 illustrates another example configuration of the radiation conductor.
Figure 4:
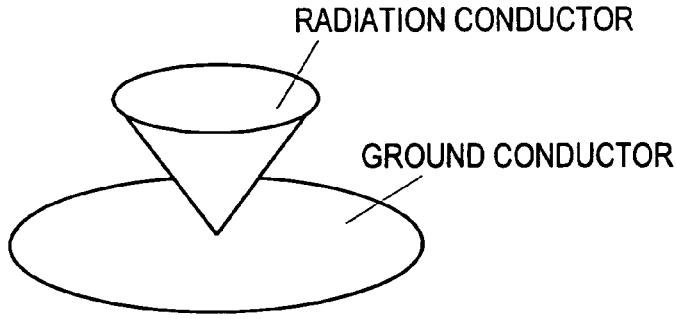
FIG. 4 illustrates another example configuration of the radiation conductor.
Figure 5:
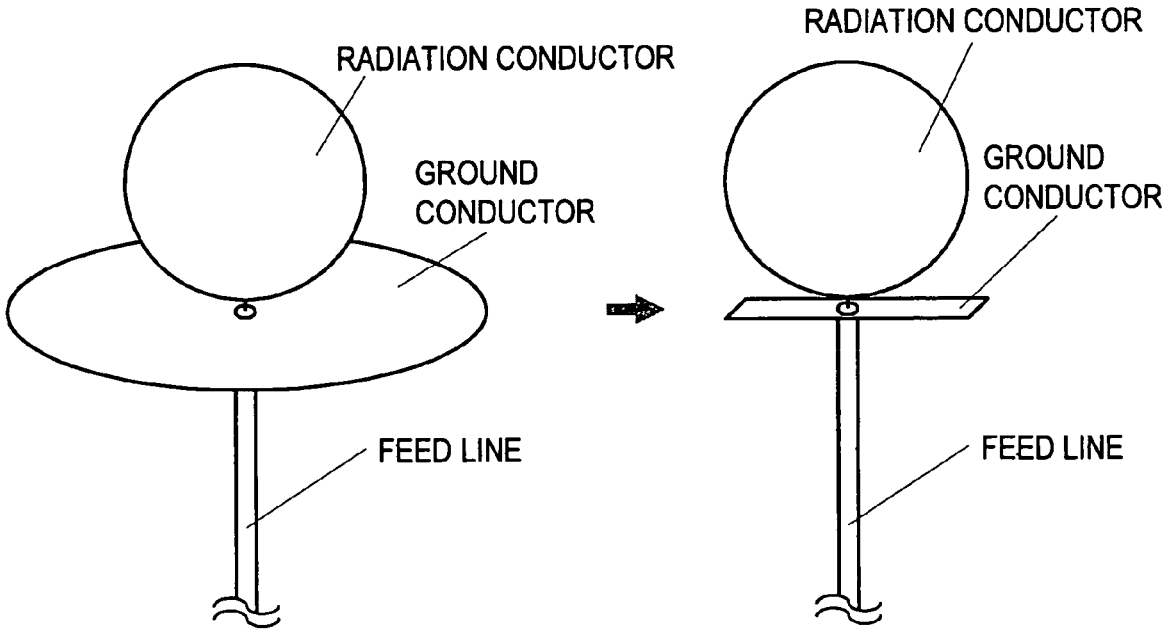
FIG. 5 illustrates the configuration of a disk monopole antenna.
Figure 9:
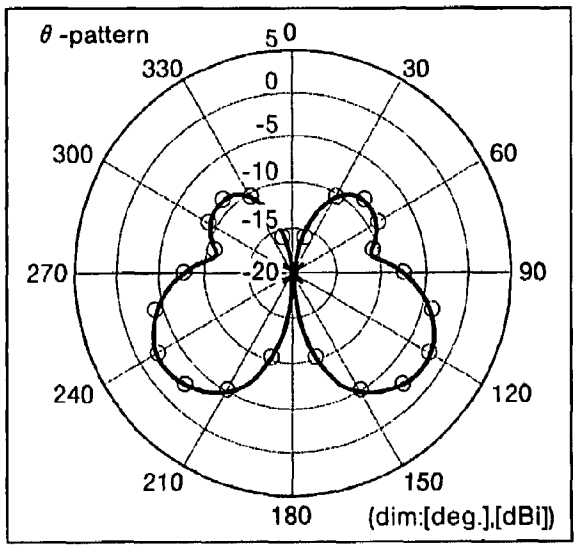
FIG. 9 shows the calculation result of an antenna characteristic of the disk monopole antenna shown in FIG. 8.
Figure 9:
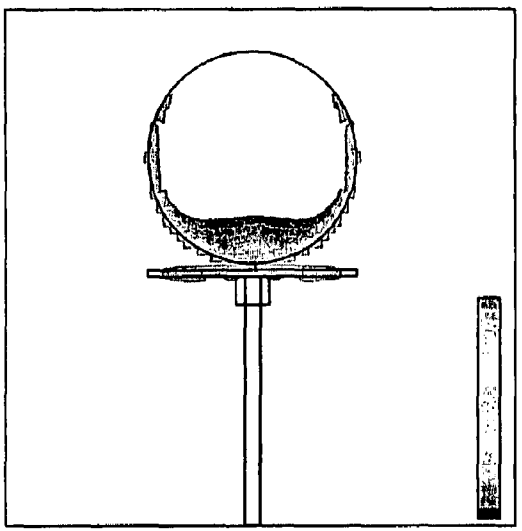
Figure 9:
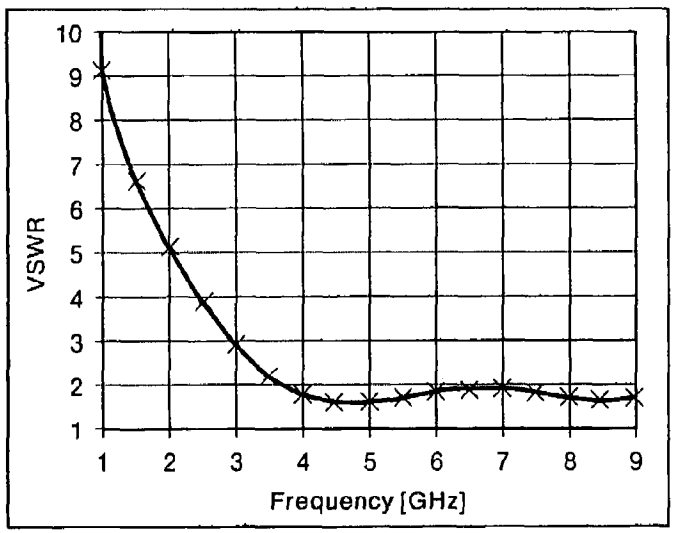

FIG. 9 illustrates the calculation result of the antenna characteristic of the monopole antenna shown in FIG. 8. The VSWR characteristic indicating an impedance matching characteristic is shown on the left side of this drawing, the radiation directivity in a vertical surface at 3 GHz is shown in the middle, and the surface-current density distribution also at 3 GHz (the density is shown by concentration) is shown on the right side of this drawing. The dimensions of the radiation conductor and the ground conductor are the same as those (the right side) of FIG. 5.

1. Radiation Conductor a metal having a conductivity of $1\times10^7$ S/m 24.8 mm in diameter, 0.8 mm in thickness 2. Ground Conductor a metal having a conductivity of $1\times10^7$ S/m a rectangular plate being 24.8×4×0.8 mm 3. Feed Section a gap of 0.8 mm a coaxial transmission line having a characteristic impedance of 50 Ω

In addition to that, the conductivity of parts starting at both ends of the ground conductor and extending for 6.4 mm is determined to be 8 S/m.

Figure 6:
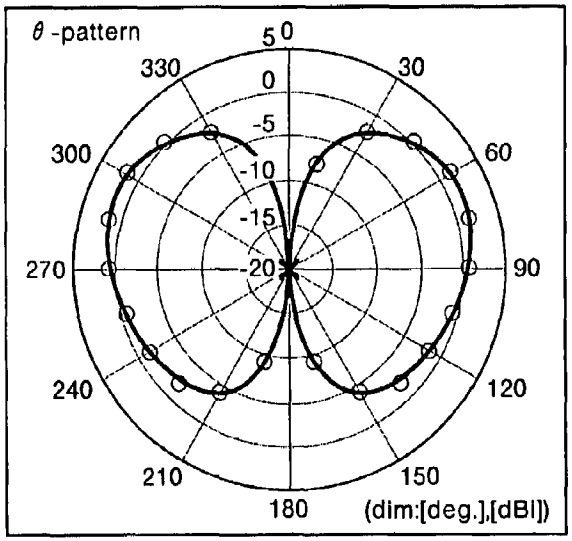
FIG. 6 shows the calculation result of a characteristic of the disk monopole antenna having a disk-like ground conductor measuring a half wave in diameter.
Figure 6:
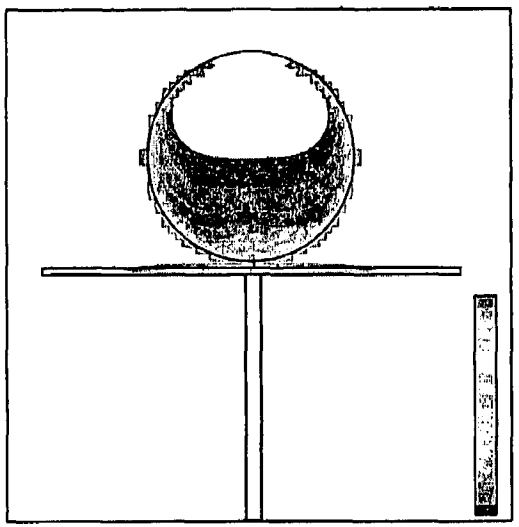
Figure 6:
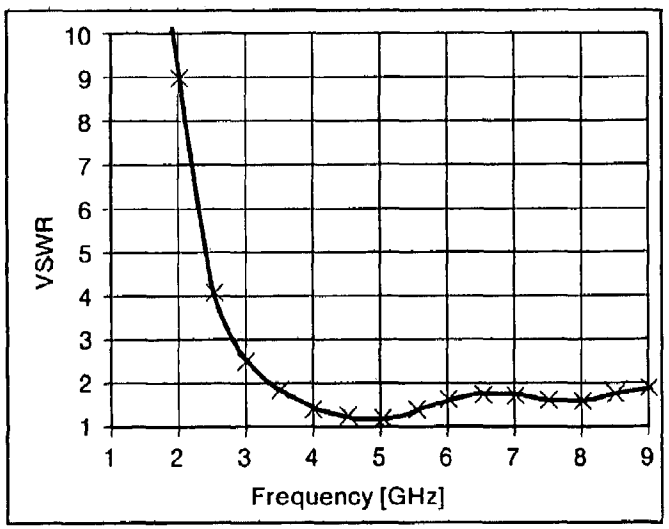

In the embodiment shown in FIG. 8, the impedance matching characteristic is apparently improved, when it is compared to the VSWR (Voltage Standing Wave Ratio) characteristic shown in FIG. 7. The VSWR value is about 2 or less over the range where the frequency is at from 3.5 to 9 GHz. That is to say, the impedance matching characteristic recovers, so as to reach the level of inherent characteristic of the disk monopole antenna shown in FIG. 6. Subsequently, the matching loss decreases and the signal distortion due to a reflected wave reduces.

On the other hand, according to the calculation result shown in the middle of FIG. 9, the radiation directivity in the vertical surface at 3 GHz is not improved, when it is compared to FIG. 7. However, the radiation-directivity disturbance as such can be reduced by improving the manner of wiring the feed line. For example, the feed line may be provided, so as to be orthogonal (or horizontal) to the radiation conductor. All contributions from the leakage current are converted into horizontal polarization components and not mixed with vertical polarization components from the radiation conductor. That is to say, even though radiation power distributes, the form of the vertical-polarization radiation directivity is maintained in its inherent state.

Figure 10:
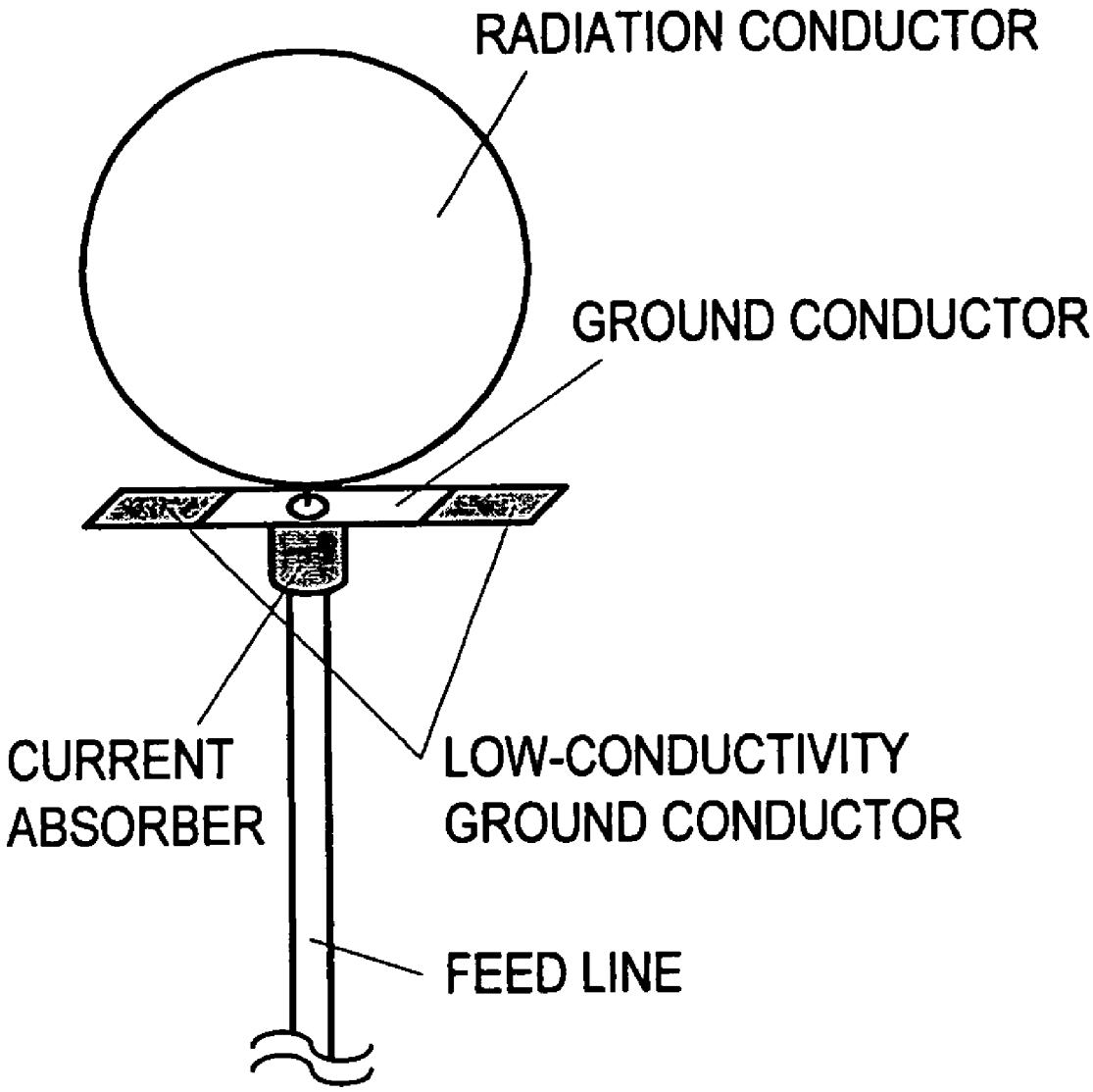
FIG. 10 schematically shows the configuration of an unbalanced antenna according to another embodiment of the present invention.

FIG. 10 illustrates the configuration of an unbalanced antenna according to another embodiment of the present invention. This drawing also shows the disk monopole antenna as an example of the unbalanced antenna.

The disk monopole antenna shown in this drawing has a disk-like radiation conductor and a rectangular-plate-like ground conductor that are provided with a predetermined gap therebetween. In this case, the size of the ground conductor is limited, so as to correspond to a p art substantially opposite to the radiation conductor. Further, parts near ends of the ground conductor, the ends being provided at a predetermined distance from a feed section, are formed by using conductors with lower conductivity. An electric signal is fed through a coaxial transmission line from the rear side of the ground conductor. The coaxial transmission line is finally connected to the gap.

According to this embodiment, a part of an external conductor of the coaxial transmission line is covered by a current absorber. An insulator including a suitable amount of conductive material, that is, an electrical resistor is used as the current absorber. The use of an electric resistor with high magnetic permeability allows for reducing the length and thickness of the part to be covered, which is suitable for achieving a reduced configuration. Further, the position of the part to be covered may preferably be very close to the feed-section side (gap side).

Figure 11:
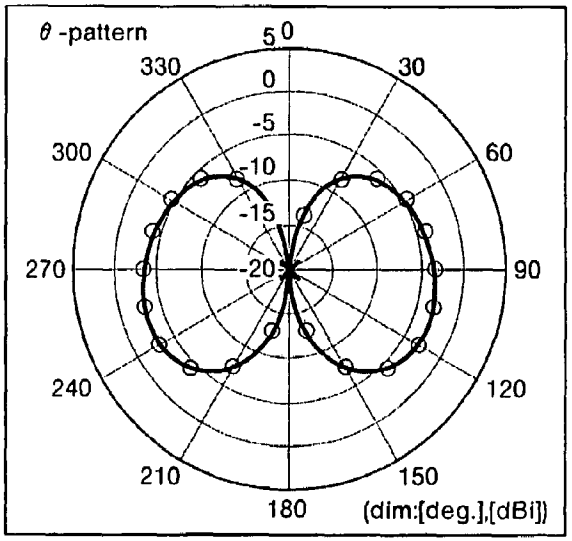
FIG. 11 shows the calculation result of an antenna characteristic of the disk monopole antenna shown in FIG. 10.
Figure 11:
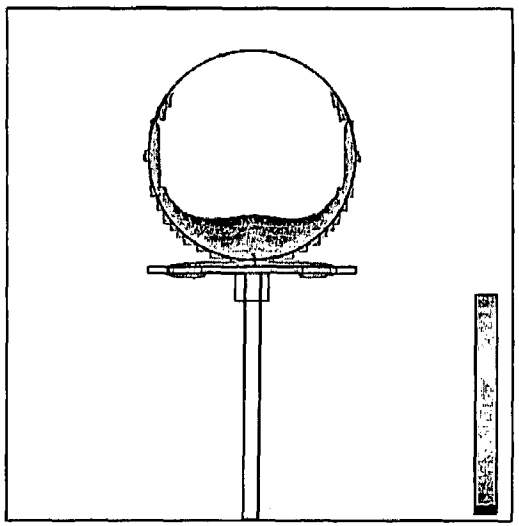
Figure 11:
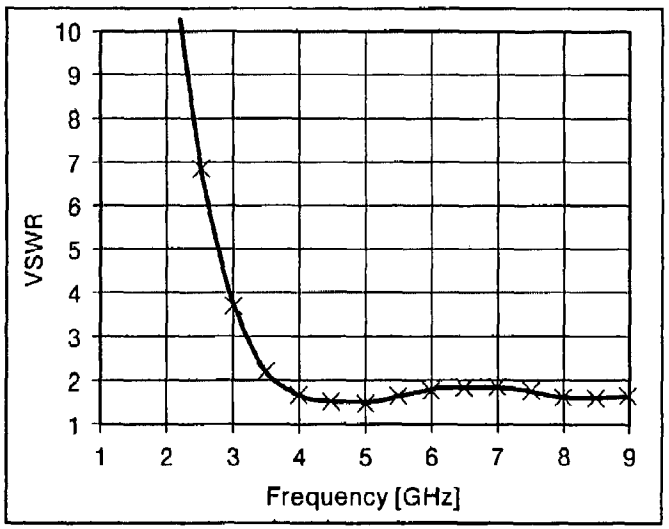
Figure 12:
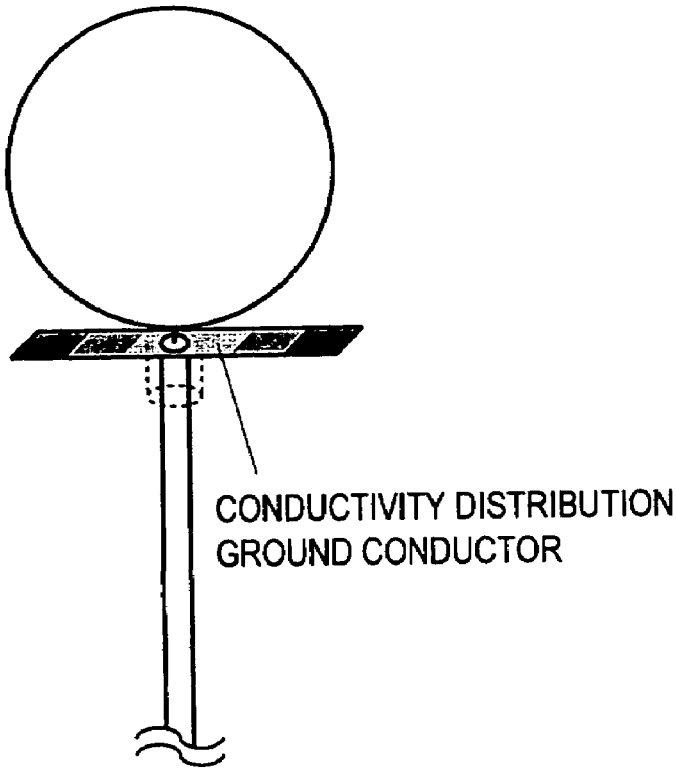
FIG. 12 schematically shows the configuration of an unbalanced antenna according to another embodiment of the present invention.

FIG. 11 illustrates the calculation result of the antenna characteristic of the disk monopole antenna shown in FIG. 10. The VSWR characteristic indicating an impedance matching characteristic is shown on the left side of this drawing, the radiation directivity in a vertical surface is shown in the middle of the drawing, and the surface-current density distribution (the density is shown by concentration) is shown on the right side of this drawing. The calculation conditions are the same as those of the calculations shown in FIG. 9. In addition to that, a current absorber having predetermined electrical constants including a conductivity of 0.1 S/m and an electrical constant, that is, a relative magnetic permeability of 400 is provided immediately below the ground conductor. The current absorber is 3.2 mm in length, 1.6 mm in thickness, and is used as a covering.

In the example shown in FIG. 11, the impedance matching characteristic and even the disturbance in the radiation directivity are improved. Although the radiation power is slightly reduced, an inherent eight-figured characteristic having peaks along a horizontal direction is obtained. According to the surface-current density distribution at this time, the level of an unnecessary leakage current flowing on the external conductor of the coaxial transmission line is low. Therefore, the radiation-directivity result is acceptable. That is to say, according to the unbalanced antenna of the embodiment shown in FIG. 10, an inherent and stable radiation directivity can be expected irrespective of the wiring of the feed line.

In the embodiments shown in FIGS. 8 and 10, the entire ground conductor may be formed as a conductivity-distribution ground conductor. That is to say, the conductivity of the part near the feed section is set to a high level, and the conductivity of parts near the ends is set to a low level so that the conductivity of the ground conductor changes continuously or in stages.

Figure 13:
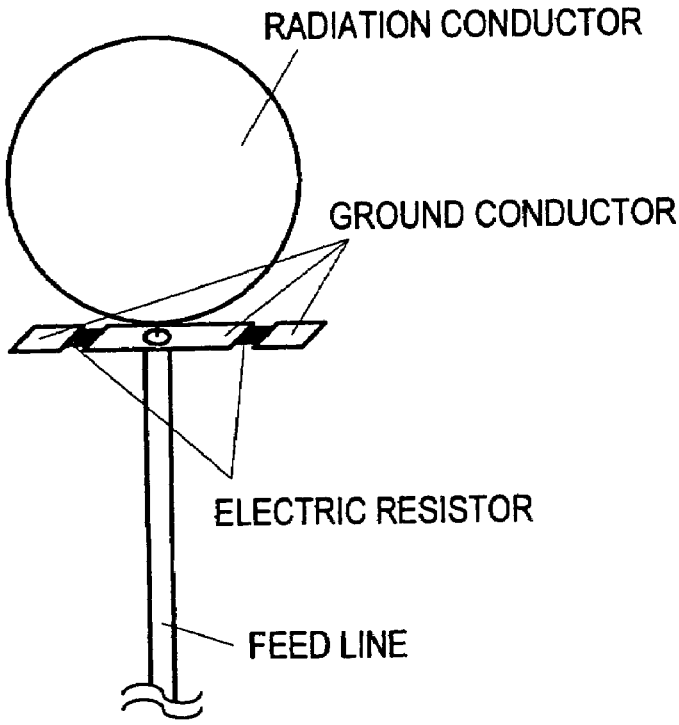
FIG. 13 shows another embodiment, wherein a ground conductor is divided into a plurality of parts and electric resistors are connected between the divided ground conductors instead of setting the conductivity of a predetermined part of the ground conductor to a low level.

FIG. 13 illustrates the configuration of an unbalanced antenna according to another embodiment of the present invention. In the embodiment shown in this drawing, a ground conductor is reduced in size except a part substantially opposite to a radiation conductor instead of setting the conductivity of a predetermined part of the ground conductor to a low level. Further, the ground conductor is divided into a plurality of parts according to the distance between a feed section and the ground conductor. Current resistors are connected between the divided ground conductors. This embodiment can also obtain an effect that is the same as that of the unbalanced antenna according to the embodiment described with reference to FIG. 8.

Figure 14:
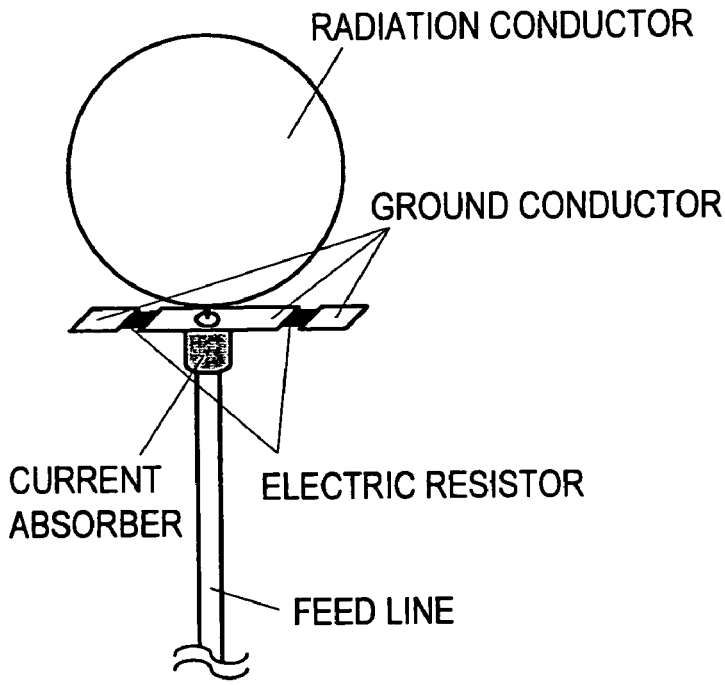
FIG. 14 illustrates an example, wherein a current absorber is used for covering a predetermined part of an external conductor of a coaxial transmission line connected to a feed section of the unbalanced antenna shown in FIG. 13.

Further, as shown in FIG. 14, a predetermined part of an external conductor of a coaxial transmission line connected to the feed section of this unbalanced antenna may be covered by a current absorber. In this case, as in the embodiment shown in FIG. 10, an inherent radiation-directivity characteristic can be expected irrespective of the wiring of the feed line.

Figure 15:
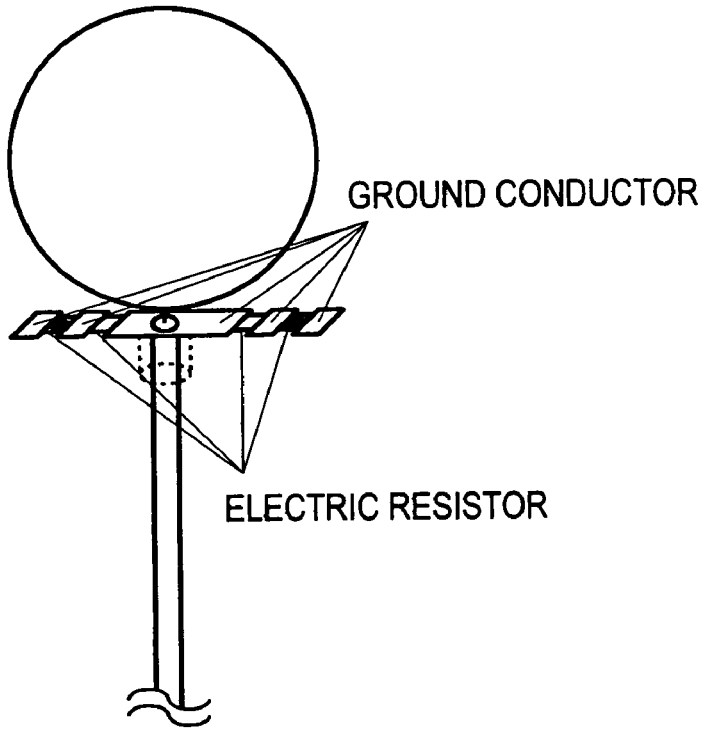
FIG. 15 illustrates an example configuration of an unbalanced antenna, wherein a ground conductor is divided into a plurality of parts and electric resistors having a suitable resistivity are provided between the divided ground conductors.

Further, in the embodiments shown in FIGS. 13 and 14, the ground conductor is reduced in size except a part substantially opposite to the radiation conductor and divided into a plurality of parts according to the distance between the feed section and the ground conductor, as shown in FIG. 15. Also, a current resistor having suitable resistivity may be respectively provided between the divided ground conductors (e.g., a current resistor having low resistivity is provided near the feed section and a current resistor having high resistivity is provided at the end).

Figure 16:
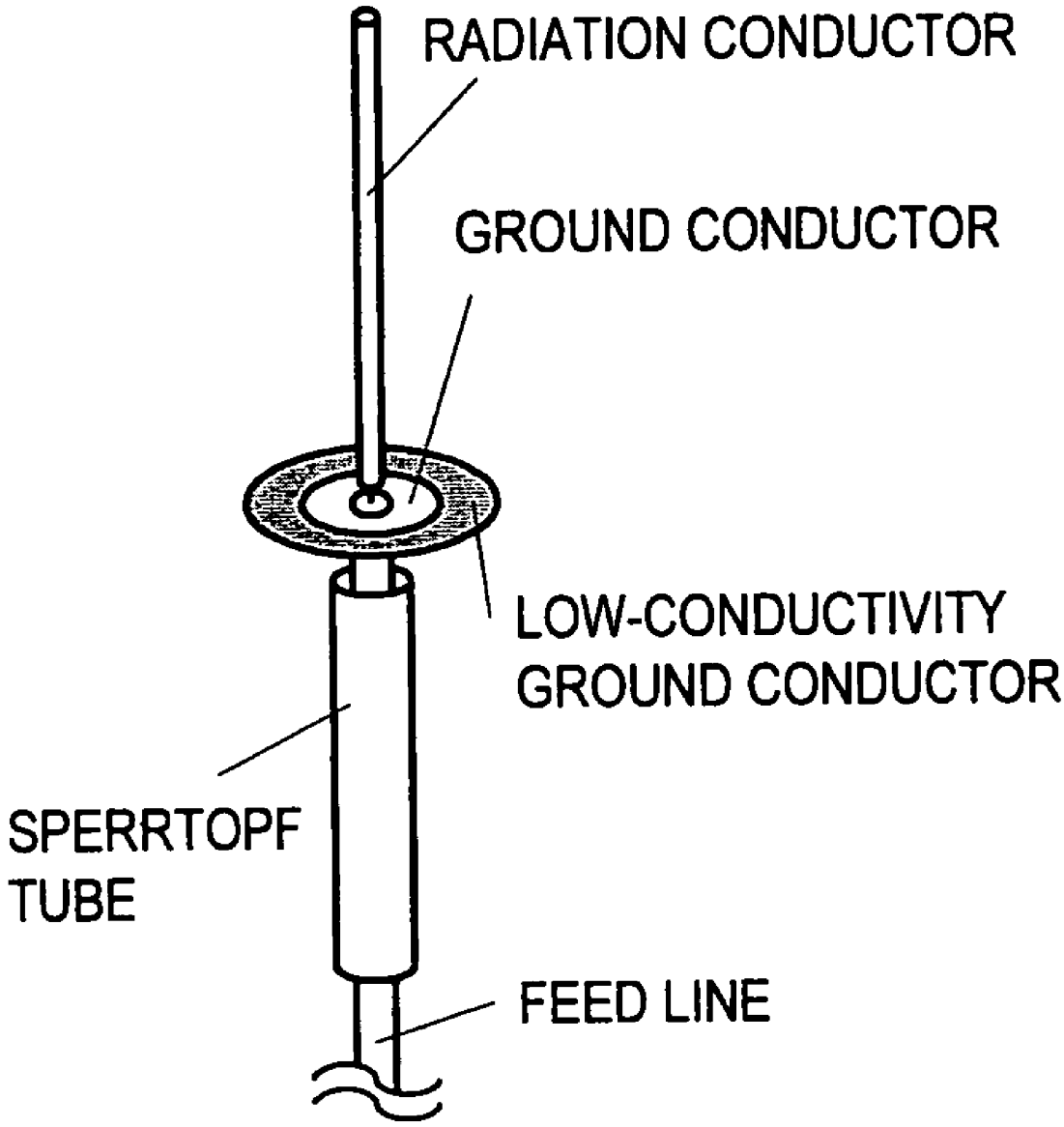
FIG. 16 illustrates an example configuration of an unbalanced antenna having a current blocking system such as a blocking ceramic tube (Sperrtopf tube) in place of the current absorber.

In the embodiments that have been described with reference to FIGS. 10, 12, 14, and 15, the mode mismatch is compensated by covering the external conductor of the coaxial transmission line by using the current absorber having the insulator including the suitable amount of conductor, that is, the electric resistor. In place of this configuration, a current blocking system such as a blocking ceramic tube (Sperrtopf tube) may be provided instead of using the current absorber, as shown in FIG. 16. Particularly, where the ground conductor divided into the plurality of parts according to the distance from the feed section is used for a relatively narrow-band unbalanced antenna such as a monopole antenna, a wide-band blocking system such as the current absorber is unnecessary. Subsequently, it becomes possible to obtain an inherent advantage of the present invention by using a distribution-constant current blocking system having a limited frequency characteristic, such as the blocking ceramic tube. Of course, the wide-band unbalanced antenna, such as the disk monopole antenna can be effectively used as a system for correcting radiation directivity at a predetermined frequency.

In the above-described embodiments, the disk monopole antenna, or the monopole antenna has been described, as an example. However, the present invention can be used for other types of unbalanced antennas.

Figure 17:
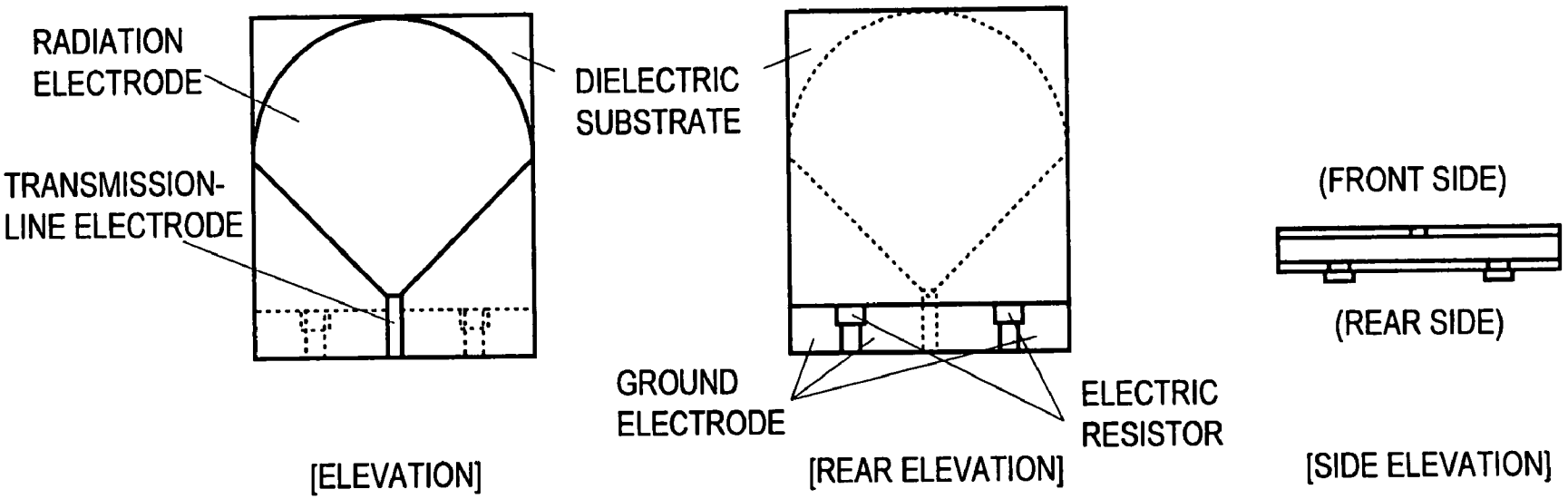
FIG. 17 shows a specific mounting example of an unbalanced antenna including a dielectric substrate.

FIG. 17 specifically illustrates a method for mounting the unbalanced antenna shown in FIG. 8. In an embodiment shown in this drawing, the unbalanced antenna includes a widely available dielectric substrate.

In this drawing, a double-sided copper-clad dielectric substrate, that is, a so-called single-layered dielectric substrate is used. A plate-like radiation electrode and a strip-like (narrow-plate-like) transmission-line electrode connected thereto are provided on one of surfaces of the dielectric substrate. As shown in this drawing, the radiation electrode has a shape including a semicircle combined with a right isosceles triangle, for example.

Where the disk monopole antenna is formed in free space, slight adjustment of the feed gap easily achieves impedance matching. However, where a circular disk monopole antenna is formed on an electrode provided on a so-called dielectric substrate, the inventors perceived that there are limitations for the matching adjustment. The inventors further perceived that the above-described shape including the semicircle combined with the right isosceles triangle is suitable, where the most widely available glass-epoxy substrate (with a relative permittivity $\epsilon$ of 4 to 5) is used.

Further, a ground electrode is provided on the other surface of the single-layered dielectric substrate, so as to be near a part facing the transmission-line electrode. The ground electrode and the transmission-line electrode together form a so-called micro-strip line.

Further, two sub-ground electrodes are provided on both sides of the ground electrode, so as to be adjacent thereto.

The breadth of the entire ground electrode including the sub-ground electrodes is determined to be almost the same as that of the radiation electrode, thereby maintaining the function of serving as a pole opposed to the radiation electrode.

Further, electric resistors are connected between the ground electrode and the sub-ground electrodes. Chip-type resistors are used as the electric resistors, for example. An electrical signal is fed between the transmission-line electrode and the ground electrode.

Although the unbalanced antenna provided on the single-layered dielectric substrate, as in FIG. 17, has the reduced ground electrode, it can obtain a fine impedance-matching characteristic, as is the case with FIG. 8.

Figure 18:
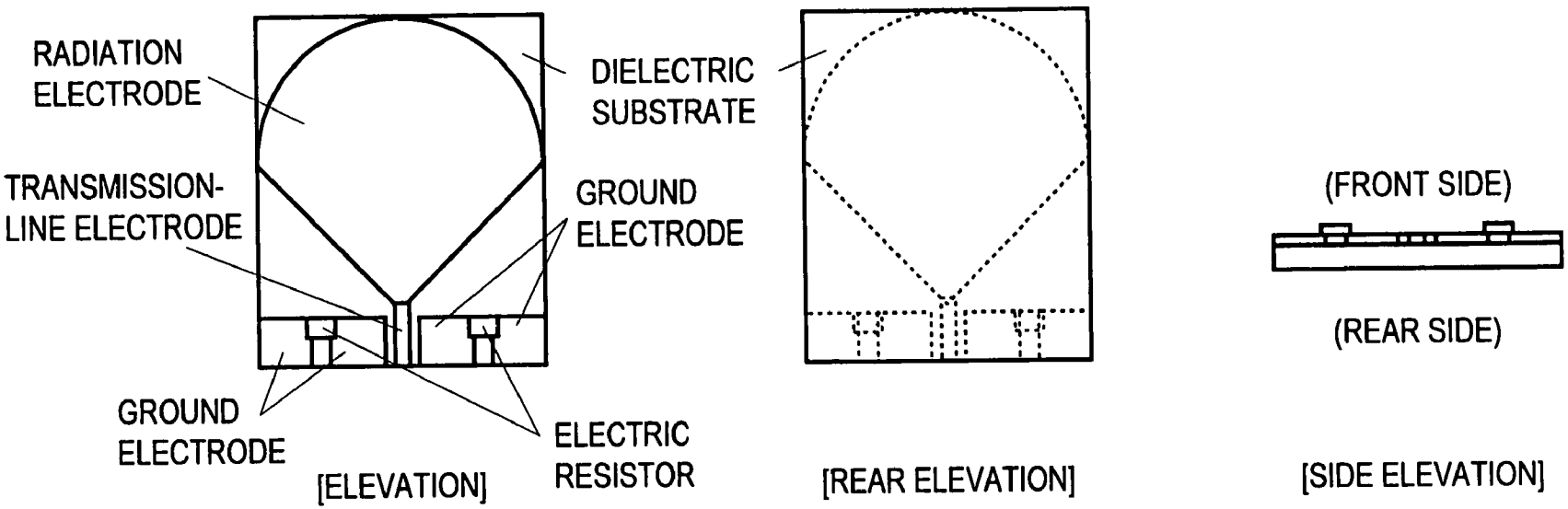
FIG. 18 shows another specific mounting example of the unbalanced antenna including the dielectric substrate.

FIG. 18 specifically illustrates a method for mounting the unbalanced antenna shown in FIG. 8. The unbalanced antenna of the illustrated embodiment includes the widely available dielectric substrate.

The difference between the embodiment shown in FIG. 18 and that shown in FIG. 17 is that all the electrodes of the former embodiment are provided on either face of the single-layered dielectric substrate. Subsequently, as shown in the drawing, the ground electrode is divided into left and right parts, so as to sandwich the transmission-line conductor. These ground electrodes and the transmission-line electrode form a so-called coplanar line.

Further, two sub-ground electrodes are provided on both sides of the ground electrode, so as to be adjacent thereto. The breadth of the entire ground electrode including the sub-ground electrodes is determined to be almost the same as that of the radiation electrode, whereby the function of serving as a pole opposed to the radiation electrode is maintained.

Further, electric resistors are connected between the ground electrode and the sub-ground electrodes. The chip-type resistors are used as the electric resistors, for example. An electrical signal is fed between the transmission-line electrode and the ground electrode.

Where the unbalanced antenna includes the electrodes centralized on either side of the single-layered dielectric substrate, as shown in FIG. 18, it becomes possible to obtain a fine impedance-matching characteristic, even though the ground electrode is reduced in size.

Figure 19:
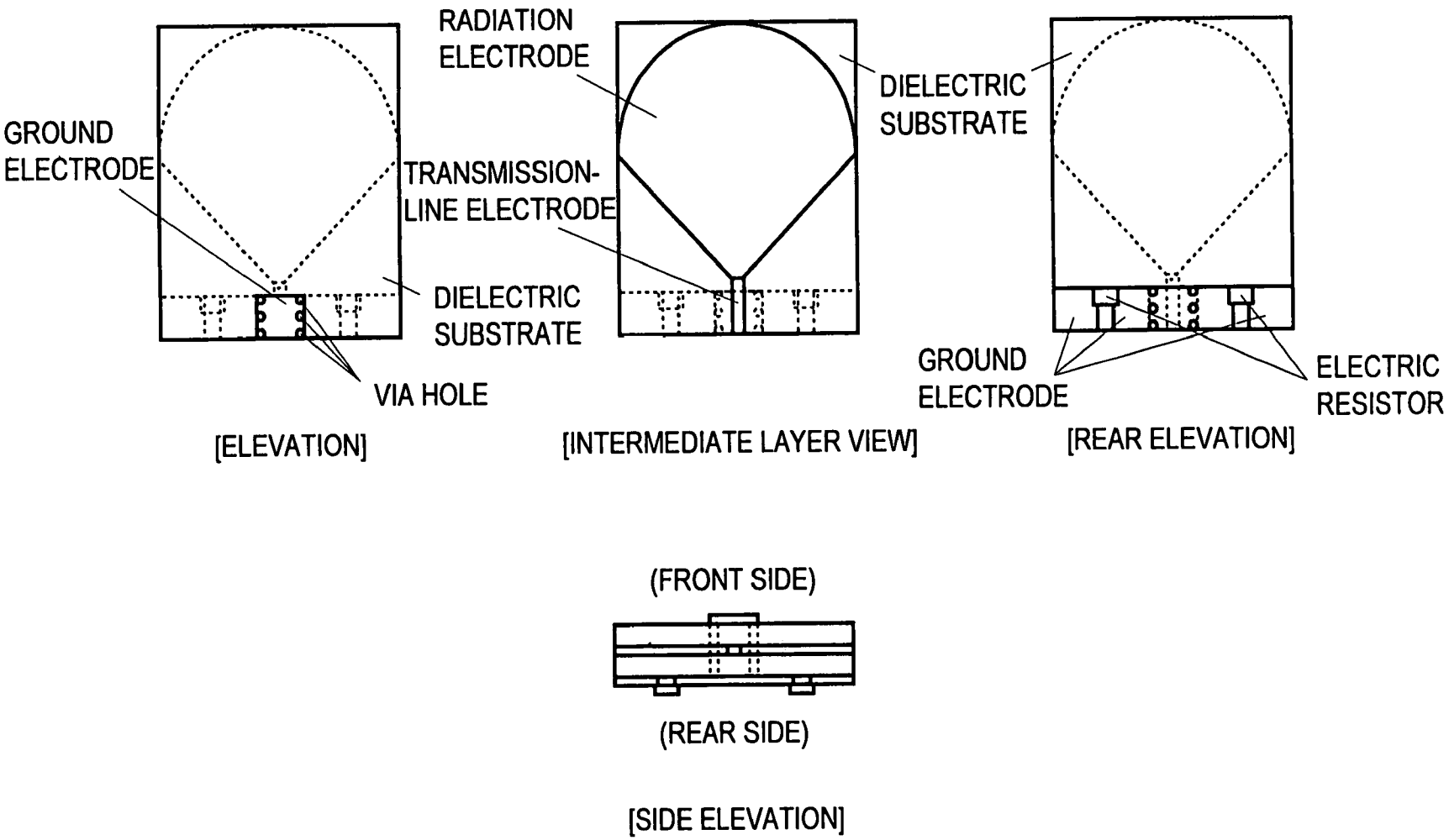
FIG. 19 shows another specific mounting example of the unbalanced antenna including the dielectric substrate.

FIG. 19 illustrates another mounting method, where an unbalanced antenna including a dielectric substrate is used. This embodiment shown in this drawing is different from those described with reference to FIGS. 17 and 18 in that the unbalanced antenna is formed by using a multi-layered dielectric substrate. Particularly, in the embodiment shown in this drawing, there is provided a multi-layered dielectric substrate having three layers, that is, upper, middle, and lower layers.

In the embodiment shown in FIG. 19, the configurations of the intermediate-layer surface and the lower-layer surface are the same as those of the specific example shown in FIG. 17, where the single-layered dielectric substrate is used. That is to say, a plate-like radiation electrode and a strip-like (narrow-plate like) transmission-line electrode connected to this radiation electrode are provided on the intermediate-layer surface. The radiation electrode has a shape having a semicircle combined with a right isosceles triangle, for example, as shown in the drawing.

A ground electrode is provided near a part of the lower-layer surface, the part being opposed to the transmission-line electrode. Further, two sub-ground electrodes are provided on both sides of the ground electrode, so as to be adjacent thereto. The breadth of the entire ground electrode including the sub-ground electrodes is determined to be almost the same as that of the radiation electrode, whereby the function of serving as a pole opposed to the radiation electrode is maintained. Electric resistors are connected between the ground electrode and the sub-ground electrodes. The chip-type resistors are used, as the electric resistors, for example.

An opposed ground electrode is provided near a part of the upper-layer surface, the part being opposed to the transmission-line electrode. Further, a plurality of through via holes is provided on both sides of the transmission-line electrode on the intermediate-layer surface, so as to sandwich the transmission-line electrode. Subsequently, the ground electrode on the lower-layer surface is electrically connected to the opposed ground electrode on the upper-layer surface. These ground electrodes and the transmission-line electrode together form a so-called strip line.

An electrical signal is fed between the transmission-line electrode and the ground electrodes, or the transmission-line electrode and the opposed ground electrode. According to the mounting example shown in FIG. 19, it becomes possible to obtain a fine impedance matching characteristic, as is the case of FIG. 8, even though the ground conductor is reduced in size.

Figure 20:
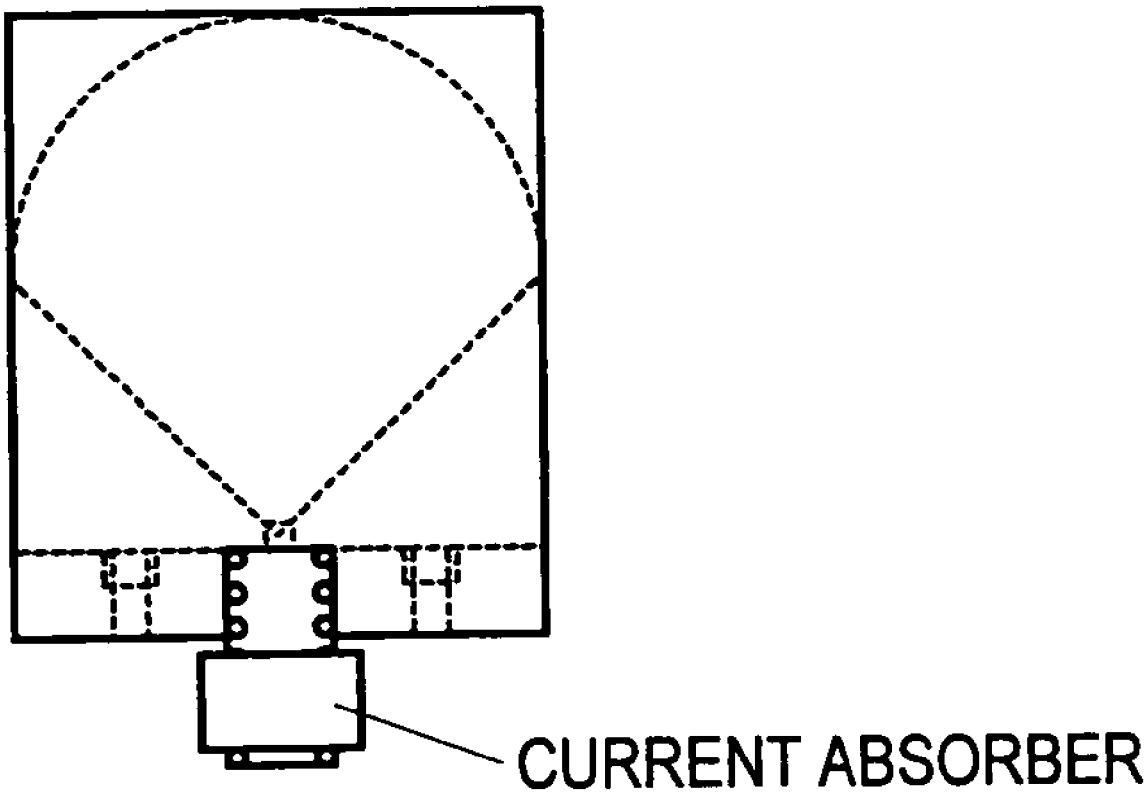
FIG. 20 shows another specific mounting example of the unbalanced antenna including the dielectric substrate.

Further, FIG. 20 illustrates another mounting example, where an unbalanced antenna is formed by using a multi-layered dielectric substrate having three electrode layers, that is, upper, intermediate, and lower layers. According to the illustrated embodiment, a current absorber is added to the mounting example shown in FIG. 19, so as to cover a part of a periphery of a ground electrode and an opposed ground electrode. More preferably, the current absorber covers the part of the periphery of the ground electrode and the opposed ground electrode, so as to be in intimate contact therewith.

According to the mounting embodiment shown in FIG. 20, a fine impedance-matching characteristic can be obtained, as in the embodiment of the present invention shown in FIG. 8, even though the ground conductor is reduced in size. Further, it becomes possible to expect a stable radiation directivity specific to the unbalanced antenna irrespective of the wiring of the feed line, as is the case with the embodiment of the present invention shown in FIG. 10.

Thus, specific examples for forming the unbalanced antennas according to the present invention by using the dielectric substrates have been described with reference to FIGS. 17 to 20. However, the main point of the present invention is not limited to the shapes shown in the drawings. Further, a large number of the sub-ground electrodes may be provided end to end, so as to be adjacent to one another.

Figure 21:
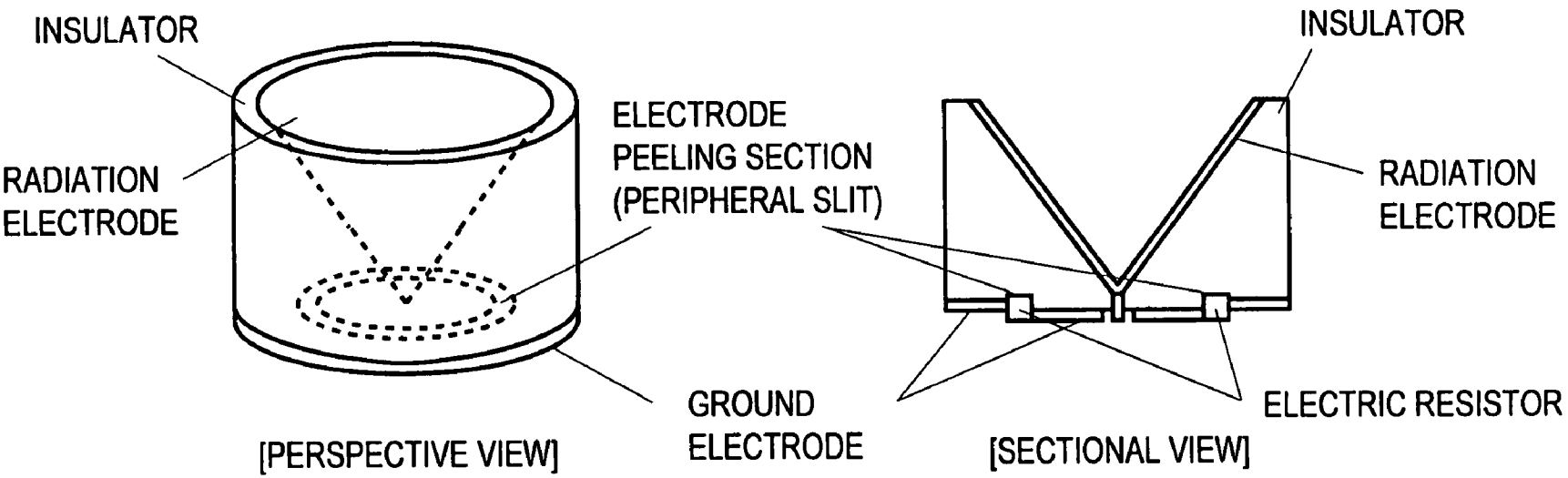
FIG. 21 shows a specific mounting example of an unbalanced antenna including an insulator body.

FIG. 21 illustrates a specific mounting example, where an insulator body such as a widely available engineering plastic is used for forming the unbalanced antenna according to the present invention.

First, a cone-shaped indentation is provided on one of end faces of the insulator and a radiation electrode is formed on the surface of the inside of the indentation by a plating method or the like. Otherwise, the radiation electrode may be formed, so as to fill the entire indentation.

Then, the radiation electrode is extended from the apex of the indentation, so as to reach the other end face opposed to the end face of the insulator, and a ground electrode is provided on the other end face, so as to enclose the extended radiation electrode. The size of the ground electrode is determined to be almost the same as that of the base of the indentation, so as to maintain the function of serving as a pole opposed to the radiation electrode.

Further, a peripheral part of the ground electrode is peeled off and a predetermined exposed part of the insulator is bored. Then, an electric resistor is embedded in the bored part. The electric resistor may be formed by using rubber or elastomer including a suitable amount of conductor. An electric signal is fed between the extended radiation electrode and the ground electrode.

According to the embodiment shown in FIG. 21, it becomes possible to obtain a fine impedance matching characteristic, as is the case of FIG. 8, even though the ground conductor is reduced in size.

Further, the shape of the indentation provided in the insulator body is not limited to the cone shape shown in FIG. 21. For example, it may be an elliptic cone, or a pyramid. Further, the outside shape of the insulator body is not limited. Basically, the outside shape may be anything having two opposing end faces, such as a cylinder or a prism.

The number of the peeled and bored peripheral part formed on the ground electrode on the base is not limited to one, but can be two or more. Further, as shown in the drawing, a step may be deliberately provided on the surface of the ground electrode, so as to be easily mounted on the substrate.

Supplement

The present invention has been illustrated with reference to the specific embodiments. However, it is obvious that the embodiments can be modified or substituted by those skilled in the art without leaving the scope of the present invention. That is to say, since the present invention has been disclosed through exemplification, it should not be limited thereto. The scope of the present invention should be determined by referring to the claims.

INDUSTRIAL APPLICABILITY

The present invention allows for significantly reducing a ground conductor of an unbalanced antenna of any kind, while reducing a significant deterioration of the impedance-matching characteristic and radiation directivity of the unbalanced antenna. Further, the present invention can make almost full use of the capabilities of an unbalanced antenna, where the unbalanced antenna is mounted on a rather small unwired communications device.

Further, the present invention can be effectively used for an unbalanced antenna for a very wide frequency band. Therefore, the present invention is suitable for downsizing an antenna of an ultra-wide-band communications system.

The invention claimed is:

1. An unbalanced antenna comprising a radiation conductor and a ground conductor that are provided with a predetermined gap therebetween, wherein the ground conductor comprises:

a predetermined part functioning as a pole for forming a near electromagnetic-field distribution together with the radiation conductor opposed to the ground conductor and a predetermined part for contributing to impedance matching.

2. An unbalanced antenna according to claim 1, wherein the ground conductor is reduced in size except at least a predetermined part substantially opposed to the radiation conductor, and wherein a predetermined part of the ground conductor includes a conductor having low conductivity, the predetermined part being near an end at a predetermined distance from a feed section.

3. An unbalanced antenna according to claim 1, wherein the ground conductor further has a predetermined part contributing to mode matching by reducing a leakage current generated from a feed section.

4. An unbalanced antenna according to claim 1, wherein feeding is achieved via a substantially coaxial transmission line, and wherein at least one part of an external conductor of a substantially coaxial feed line connected to a feed section is covered by a current absorber.

5. An unbalanced antenna according to claim 1, wherein, conductivity of the ground conductor is reduced continuously or in stages along a direction from a part near the feed section to an end.

6. An unbalanced antenna according to claim 1, wherein a Sperrtopf tube or a current blocking system analogous thereto is provided on an external conductor of a substantially coaxial transmission line connected to the feed section of the unbalanced antenna.

7. An unbalanced antenna comprising a radiation conductor and a ground conductor that are provided with a predetermined gap therebetween, wherein the ground conductor is reduced in size except at least a predetermined part substantially opposed to the radiation conductor and divided into a plurality of parts according to a distance from a feed section, and wherein electric resistors are connected between the divided ground conductors.

8. An unbalanced antenna according to claim 7, wherein a predetermined part of an external conductor of a substantially coaxial transmission line connected to the feed section of the unbalanced antenna is covered by a current absorber.

9. An unbalanced antenna according to claim 7, wherein at least an electric resistor having a suitable resistivity is respectively provided between the divided ground conductors.

10. An unbalanced antenna according to claim 9, wherein the conductivity of the electric resistor, the electric resistor being near the feed section, is set to a low level, and wherein the conductivity of the electric resistor, the electric resistor being near the end, is set to a high level.

11. An unbalanced antenna comprising:

a single-layered dielectric substrate having two electrode surfaces, that is, upper-layer and lower-layer electrode surfaces;

a plate-like radiation electrode and a transmission-line electrode connected to the radiation electrode that are formed on one of surfaces of the single-layered dielectric substrate;

a ground electrode formed near a predetermined part of the other surface of the single-layered dielectric substrate, the predetermined part being opposed to the transmission-line electrode;

at least one sub-ground electrode provided, so as to be adjacent to the ground electrode;

an electric resistor connected between the ground electrode and the sub-ground electrode; and an electric-signal feed path provided between the transmission-line electrode and the ground electrode.

12. An unbalanced antenna according to claim 11, wherein the breadth of the entire ground electrode including the sub-ground electrode is set, so as to be substantially the same as that of the radiation electrode.

13. An unbalanced antenna according to claim 11, wherein the electric resistor is formed by using a chip-type resistor.

14. An unbalanced antenna according to claim 11, wherein a plurality of the sub-ground electrodes are provided end to end, so as to be adjacent to one another.

15. An unbalanced antenna comprising:

a single-layered dielectric substrate having two electrode surfaces, that is, upper-layer and lower-layer electrode surfaces;

a plate-like radiation electrode and a transmission-line electrode connected to the radiation electrode that are formed on one of surfaces of the single-layered dielectric substrate;

a ground electrode that is flush with the radiation electrode and the transmission-line electrode and that is divided, so as to sandwich the transmission-line electrode;

at least one sub-ground electrode provided, so as to be adjacent to the ground electrode;

an electric resistor connected between the ground electrode and the sub-ground electrode; and an electric-signal feed path provided between the transmission-line electrode and the ground electrode.

16. An unbalanced antenna according to claim 15, wherein the breadth of the entire ground electrode including the sub-ground electrode is set, so as to be substantially the same as that of the radiation electrode.

17. An unbalanced antenna according to claim 15, wherein the electric resistor is formed by using a chip-type resistor.

18. An unbalanced antenna according to claim 15, wherein a plurality of the sub-ground electrodes are provided end to end, so as to be adjacent to one another.

19. An unbalanced antenna comprising:

a multi-layered dielectric substrate having three electrode surfaces, that is, upper-layer, intermediate-layer, and lower-layer electrode surfaces;

a plate-like radiation electrode and a transmission-line electrode connected to the radiation electrode that are formed on the intermediate-layer surface of the multi-layered dielectric substrate;

a ground electrode formed near a predetermined part of the lower-layer surface of the multi-layered dielectric substrate, the predetermined part being opposed to the transmission-line electrode;

at least one sub-ground electrode provided, so as to be adjacent to the ground electrode;

an electric resistor connected between the ground electrode and the sub-ground electrode;

an opposed ground electrode formed near a predetermined part of the upper-layer surface of the multi-layered dielectric substrate, the predetermined part being opposed to the transmission-line electrode;

two or more inter-ground-electrode connection sections for electrically connecting the ground electrode to the opposed ground electrode; and an electric-signal feed path formed between the transmission-line electrode and the ground electrode, and/or the transmission-line electrode and the opposed ground electrode.

20. An unbalanced antenna according to claim 19, wherein the inter-ground-electrode connection sections are provided on both sides of the transmission-line electrode provided on the intermediate-layer surface of the multi-layered dielectric substrate, so as to sandwich the multi-layered dielectric substrate.

21. An unbalanced antenna according to claim 19, further comprising:

a current absorber covering a predetermined part of a periphery of the ground electrode and the opposed ground electrode.

22. An unbalanced antenna according to claim 19, wherein the breadth of the entire ground electrode including the sub-ground electrode is set, so as to be substantially the same as that of the radiation electrode.

23. An unbalanced antenna according to claim 19, wherein the electric resistor is formed by using a chip-type resistor.

24. An unbalanced antenna according to claim 19, wherein a plurality of the sub-ground electrodes are provided end to end, so as to be adjacent to one another.

25. An unbalanced antenna comprising:

an insulator having opposing end faces;

a radiation electrode formed on a surface of a substantially cone-shaped indentation formed on one of end faces of the insulator, or formed in the indentation, so as to fill the entire indentation;

a radiation-electrode extension portion formed by extending the radiation electrode from an approximate apex of the indentation so that the radiation-electrode extension portion reaches the other end face opposed to the end face of the insulator;

a ground electrode formed on the other end face of the insulator, so as to enclose the radiation-electrode extension portion;

at least one circumferential slit portion formed by peeling off a predetermined periphery part of the ground electrode;

an electric resistor embedded in the circumferential slit portion; and an electric-signal feed section provided between the radiation-electrode extension portion and the ground electrode.

26. An unbalanced antenna according to claim 25, wherein the size of the ground electrode is substantially the same as that of the base of the indentation.

27. An unbalanced antenna according to claim 25, wherein the ground electrode has a step, where the circumferential slit portion constitutes an edge of the step.

* * * * *